US006188224B1

(12) United States Patent
Hannoyer et al.

(10) Patent No.: US 6,188,224 B1
(45) Date of Patent: Feb. 13, 2001

(54) PROCESS FOR THE DIAGNOSIS OF AN IGNITION DEVICE OF AN INTERNAL COMBUSTION ENGINE

(75) Inventors: Gilles Hannoyer; Philippe Blanchard, both of Castanet; Catherine Meyer, Beaupuy; Yves Geoffroy, Toulouse, all of (FR)

(73) Assignee: Siemens Automotive, S.A., Toulouse-Cedex (FR)

( * ) Notice: Under 35 U.S.C. 154(b), the term of this patent shall be extended for 0 days.

(21) Appl. No.: 09/151,963

(22) Filed: Sep. 11, 1998

(30) Foreign Application Priority Data

Sep. 11, 1997 (FR) ..... 97 11318

(51) Int. Cl.[7] ..... F02P 17/00

(52) U.S. Cl. ..... 324/380; 73/116; 123/630; 123/644

(58) Field of Search ..... 324/378, 379, 324/380, 388, 391, 393, 399; 123/406, 436, 479, 630, 644; 327/110; 73/116

(56) References Cited

U.S. PATENT DOCUMENTS 5,490,489 * 2/1996 Mayer et al. ..... 123/630

* cited by examiner

*Primary Examiner*—Safet Metjahic
*Assistant Examiner*—E. P. LeRoux
(74) *Attorney, Agent, or Firm*—Herbert L. Lerner; Laurence A. Greenberg; Werner H. Stemer

(57) ABSTRACT

The diagnosis of an open-circuit fault or of a short-circuit in an ignition system is effected by performing asynchronous periodic extraction of samples of current in a switch. A check is made to ensure the satisfaction of certain temporal conditions in respect to a moment of extraction of the samples and comparing the samples, on the basis of that the temporal conditions are satisfied, with predetermined fault threshold values.

10 Claims, 1 Drawing Sheet

PROCESS FOR THE DIAGNOSIS OF AN IGNITION DEVICE OF AN INTERNAL COMBUSTION ENGINE

BACKGROUND OF THE INVENTION

FIELD OF THE INVENTION

The subject of the present invention is a process and a device for diagnosing an ignition system of an internal combustion engine, more particularly adapted to the diagnosis of ignition systems having multiple coils.

The prior art discloses numerous devices for the diagnosis of ignition systems able to diagnose a short circuit or an open circuit of a primary circuit of a coil. Those devices generally consist of an apparatus for measuring a current flowing through the primary circuit of the coil and through an associated switch, as well as a device, generally analog, for comparing the current with a reference value. However, those devices are not suitable when multiple coils have to be controlled at least partially simultaneously. It is then necessary to employ one diagnostic device per ignition coil so that the current flowing through another coil should not disturb a previous current measurement. Moreover, those diagnostic devices need to be matched accurately to the characteristics of the coil to be monitored and have to be matched as a function of the variations in those characteristics, due either to manufacturing scatter, or to variations in operating conditions.

SUMMARY OF THE INVENTION

It is accordingly an object of the invention to provide a process for the diagnosis of an ignition device of an internal combustion engine and a device for performing the diagnosis which overcome the above-mentioned disadvantages of the prior art methods and devices of this general type, which is easily adaptable regardless of the type of coil employed and which allows diagnosis even in the case of a system having multiple ignition coils.

With the foregoing and other objects in view there is provided, in accordance with the invention, in a process for diagnosing an ignition device of an internal combustion engine, the ignition device having at least one ignition coil, a switch connected to the at least one ignition coil, a control computer emitting at least one control signal for controlling the switch, and a current measuring means for measuring a current flowing through the switch, the improvement which includes: a) periodically extracting samples of a value of the current flowing through the switch with the current measuring means; b) determining a moment of extraction and a conducting state of a circuit formed of the at least one coil and the switch at the moment of extraction for each of the samples; c) checking if the moment of extraction for each of the samples satisfies at least one temporal condition with respect to the at least one control signal emitted by the control computer; d) comparing each of the samples with a predetermined threshold value if the at least one temporal condition was satisfied during the checking step; and e) deducing a presence and nature of an operating fault of the circuit from results of the comparing step.

The objectives of the invention are achieved, together with others that will be detailed in the description that follows, by a process for the diagnosis of an ignition system for an internal combustion engine. The system includes at least one ignition coil associated with a switch controlled by a signal emitted by a control computer, and a device for measuring the current flowing through the switch. According to the invention, samples of the value of the current are extracted periodically, with each sample are associated a moment of extraction and a coil/switch circuit conduction at the moment of extraction. A check is made as to whether the moment of extraction satisfies at least one temporal condition with respect to at least one control moment emitted by the computer. The sample is compared with a predetermined threshold on the basis of the temporal condition being satisfied, and the presence and the nature of any operating fault in the associated coil/switch circuit is deduced therefrom.

According to a mode of implementation of the process according to the invention, a check is made as to whether the moment of extraction is later than the moment at which the switch is turned on by at least a first lag. The sample is compared with an open-circuit fault threshold, and an open-circuit fault is inferred if the sample is below the open-circuit fault threshold Advantageously, the steps for associating and checking the moment of extraction are repeated until the last sample is obtained and whose moment of extraction is earlier than the moment of the associated switch being turned off.

According to an advantageous characteristic of the process, when it is applied to a system having at least two coils and their associated switch, and a common device of measurement, a check is made as to whether the moment of extraction is moreover earlier than the moment of turning on of the switch of the next circuit.

According to another characteristic of the process, the first lag is determined as a function of the maximum current desired in the coil, the open-circuit fault threshold and the period of the sampling.

According to another mode of implementation of the process, applied to a system having at least two coil/switch circuits, and a common device for measuring the current flowing through the circuits, a check is made as to whether the moment of extraction of the sample is later on the one hand than the moment of turning on the switch associated with the sample by at least a second lag, and on the other hand than the moment of turning off the switch associated with previous circuit by at least a third lag. The sample is compared with a short-circuit fault threshold, and a short-circuit fault is inferred if the sample is above the short-circuit fault threshold.

With the foregoing and other objects in view there is also provided, in accordance with the invention, in an ignition device having a plurality of circuits each formed of a coil and a switch, a diagnosis apparatus including: current measuring means for measuring a current common to the plurality of circuits; means for determining a moment of events including a moment of extraction of current measuring samples, and a moment of turning on and off a respective switch of the plurality of circuits; storage means for recording at least one collection of values including a current sample, a moment of extraction of the current sample, a reference to a conduction state of each of the plurality of circuits, a set of pre-established threshold values and time lag values, and an instruction set forming part of a piece of software; and calculation and comparison means adapted for executing checking and comparison operations defined according to a process by running and executing the instruction set stored in the storage means.

The invention further discloses a device for implementing the process. The device includes a means of measurement common to a plurality of coil/switch circuits, means for determining the moment of events such as extraction of samples, turning on and off the switches, storage means adapted for recording on the one hand at least one collection of values which consists of a sample, of its moment of extraction and of a reference to an associated coil/switch circuit, on the other hand a set of pre-established values of thresholds and lags, and a set of instructions forming part of a piece of software, calculation and comparison means, adapted for executing the checking and comparison operations defined according to the process by running and executing the instruction set stored in the storage means.

Other features which are considered as characteristic for the invention are set forth in the appended claims.

Although the invention is illustrated and described herein as embodied in a process for the diagnosis of an ignition device of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
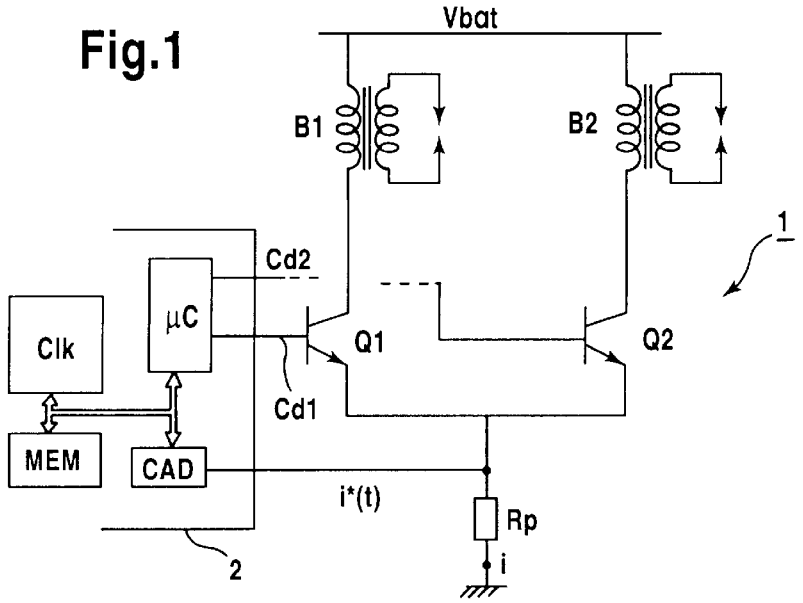
FIG. 1 is a circuit diagram of an ignition system equipped with two coils and a device capable of implementing the process according to the invention.

Referring now to the figures of the drawing in detail and first, particularly, to FIG. 1 thereof, there is shown an ignition system 1 having two coils B1 and B2 linked on the one hand to a voltage source Vbat and on the other hand respectively to two switches Q1 and Q2 controlled by an ignition computer 2. The switches Q1 and Q2 have been represented for convenience in the form of bipolar transistors but it is obvious that any other type of switch can be employed, for example MOS transistors, etc. The emitters of the switches Q1 and Q2 are linked together and their common point is linked to earth by way of a resistor Rp. The computer 2 has a microcontroller (uC) 3, a clock (Clk) 4 and a collection of memories (MEM) 5 including for example read only memories, backed-up by random access memories, etc. which are able to store a set of instructions for driving the microcontroller 3 according to a predetermined program, and for storing pre-established values of parameters, as well as measured data. The microcontroller 3 is adapted for controlling respectively the switches Q1 and Q2, for example by way of output ports and control signals Cd1 and Cd2. The microcontroller 3 is furthermore associated with an analog/digital converter (CAD) 6 which receives a signal representative of the current flowing through the switches Q1 and Q2. The signal is for example extracted at the common point between the switches Q1, Q2 and the resistor Rp and sampled asynchronously by the analog/digital converter 6. The sampled item will in the subsequent description be referred to as i*(t).

Figure 2:
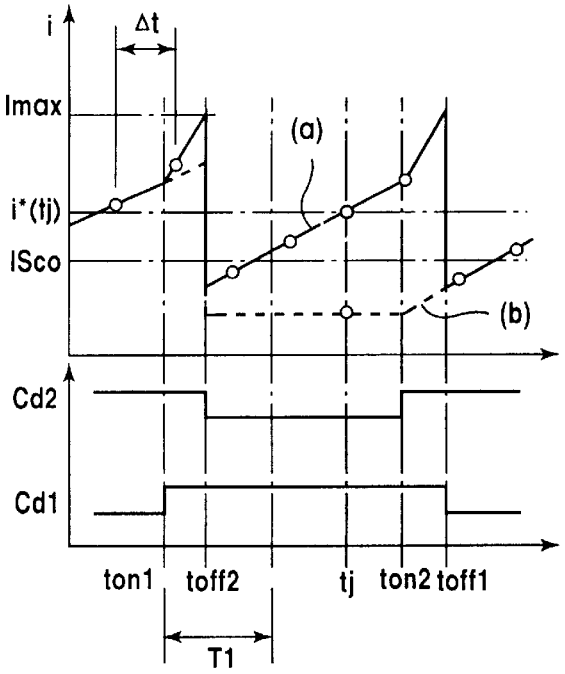
FIG. 2 are graphs of control signals and of a current over time for explaining a mode applied for detecting an open-circuit fault.

Reference is now made to FIG. 2 in which a timing diagram of the control signals cd1 and cd2 for the switches Q1 and Q2, respectively, as well as the image of the current flowing through the resistor Rp in the case of normal operation (curve (a)) and of an open circuit in the circuit of the switch Q1 (curve (b)). The sampled values i*(t) of the current extracted by the analog/digital converter 6 are portrayed on the latter curves by points. Prior to the instant of tonl (Q1 conducting), it may be observed that the control signal Cd1 is at a low level corresponding to the switch Q1 in the open state (non-conducting) and the control signal Cd2 is at a high level corresponding to the switch Q2 being on (conducting).

Therefore, the current i follows a rising curve at a first slope dependent on the characteristics of the circuit consisting of a primary of the coil B2, the switch Q2 and the resistor Rp. Studying curve (a) representative of normal operation, from the instant of ton1, the switch Q1 turns on and the current in the resistor Rp follows a steeper slope corresponding to the current flowing simultaneously through the switches Q1 and Q2. From the instant of toff2 (Q2 non-conducting), conducting), the switch Q2 is opened, the current i decreases abruptly and reverts to the level of the current flowing through the switch Q1 at this instant and then rises in accordance with a slope corresponding to a load of the coil B1. The procedure is then repeated for ton2 simply by reversing the control of the circuits B1/Q1 and B2/Q2. Of course, in an ignition system having more than two coil circuits, the manner of operation is similar on effecting a sequential permutation of the circuits. As seen earlier, with each extraction of samples of the current flowing in the resistor Rp, the following are stored: the value i*(t) of the sample, its moment of extraction (instant/time of measurement) t and the state of the circuit B1/Q1 or B2/Q2 (conducting/non-conducting) during the extraction. According to the invention, when it is desired to detect the presence of an open circuit, a check is carried out for each sample as to determine whether its moment of extraction is later by a time lag T1 than the moment of turning on the associated circuit, for example ton1 in the case of the circuit B1/Q1 conducting at the moment of its extraction. If the condition is satisfied as is the case for the sample extracted at the moment $t_j$, the value of the sample $i^*(t_1)$ is then compared with a predetermined threshold for an open-circuit detection ISco. As may be seen in the figure on studying the curve (b), in the case of an open circuit in the coil/switch circuit B1/Q1, the current i whose slope has not been modified between ton1 and toff2, takes an approximately zero value from the latter instant. Thus, if the value of the sample $i^*(t_1)$ is below the threshold ISco it is then possible to diagnose the presence of an open-circuit fault in the circuit B1/Q1. By way of example, a short-circuit detection threshold ISco of a value of 1 ampere is sufficient to allow reliable detection without being disturbed by nuisance noise. It has also been observed that it was advantageous, for reasons of reliability of diagnosis, to perform the comparison with the threshold ISco only for the last sample extracted before turning off the switch Q1 or turning on the switch Q2. To this end, sufficient room is available in the memory MEM to store the information items associated with two successive current samples. Thus, when the data associated with the last sample extracted reveal a change of state in respect of the circuit that is conducting, it is possible to compare the value of the immediately preceding sample with the fault threshold. However, when the voltage Vbat is very high, the on time of the switch Q1, determined by the maximum current imax desired in the coil, may be very short, and give rise to only a single sample, as a function of the sampling period Δt. In this case, the temporal condition imposed by the time lag T1 has the effect of preventing erroneous detection of open circuit which could occur if the sample were extracted immediately after the closing of the switch Q1, before the current I had exceeded the threshold ISco, in the case of a functional circuit. The minimum lag time T1 will therefore be determined as a function of the parameters with the following formula:

$$T1 \geqq \Delta t \times ISco/(I\max - ISco)$$

The time lag T1 is stored in the memory (MEM) 5, in the form of a single parameter or as an array of values versus other parameters such as the temperature or the battery voltage Vbat.

Figure 3:
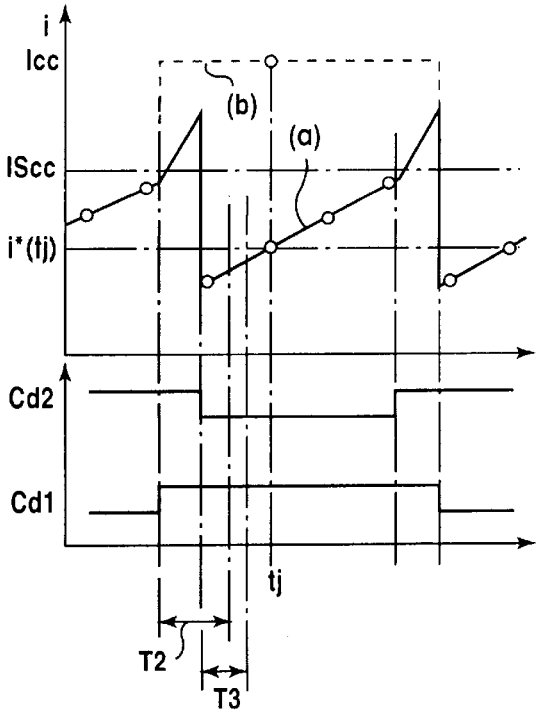
FIG. 3 are graphs of the control signals and of the current over time for explaining another mode applied for the detection of a short-circuit fault.

Reference will now be made to FIG. 3 in which the timing diagrams shown in FIG. 2 have been replotted, with the exception of curve (b) which now represents the profile of the current in the case of a short-circuit fault in the primary of the coil B1. The curve (b) shows that as soon as the switch Q1 is turned on, the current increases and reaches the short-circuit current Icc, and decreases only when Q1 is opened. The rise time of the current in the switch Q1 is non-zero, and hence in order to diagnose the fault in a valid manner, any sample which might be extracted during this rise time is masked by a second time lag T2. Likewise, in the case of partial overlap between the conducting of the relevant coil/switch circuit (here B1/Q1) and the previous one (B2/Q2), disturbance from the current fluctuations generated by the opening of Q2 are avoided by masking the samples which might be extracted during a third time lag T3 after the opening of the switch Q2. The first sample extracted after the expiry of the time lags T2 and T3 is then used to compare it with a short-circuit threshold value IScc. Hence, the temporal condition which must be satisfied in order to obtain a valid sample for the comparison is that its moment of extraction t should lie within an interval of one sampling period Δt after the expiry of the last of the time lags T2 and T3. This condition makes it possible to use a short-circuit detection threshold value IScc which is below the maximum value of the current liable to flow through the coil/switch circuits, something which was not possible in the prior art devices. This avoids certain anomalies encountered in the prior art devices where, the detection threshold being above the maximum current reached in the presence of a maximum voltage Vbat, a short-circuit present under a minimum voltage Vbat would not be detectable.

As in the case of the time lags T1, T2 and T3, as well as the thresholds IScc and ISco are stored in the memory 5 of the computer 2, possibly in the form of arrays of values versus parameters such as the temperature of the engine and/or the battery voltage Vbat.

Of course, the two modes of implementation of the process, for open-circuit or short-circuit detection, are not mutually exclusive. They may be implemented simultaneously by means of the device represented in FIG. 1, in which the analog/digital converter 6 is devised so as to extract the samples i*(t) with periodicity Δt, and transform them into digital values which will be stored concomitantly with their moment of extraction furnished by the clock Clk and an item of information relating to the circuit conducting at the moment by the microcontroller 3, in the memory 5. The memory is also suitable for receiving, as seen earlier, the values of the various thresholds ISco, IScc and of the time lags T1 to T3. The various checking and comparison operations are performed by the microcontroller 3 on the basis of program instructions also stored in the memory. The various elements, converter, clock, microcontroller and memory can consist of separate elements or elements grouped together in a special-purpose integrated circuit, and are advantageously incorporated within an engine monitoring computer which controls ignition and/or injection.

We claim:

1. A process for diagnosing an ignition device of an internal combustion engine, which comprises:

providing an ignition device including at least one ignition coil, providing a switch connected to the at least one ignition coil, providing a control computer emitting at least one control signal for controlling the switch, and providing a current measuring means for measuring a current flowing through the switch;

performing a sampling step defined by periodically extracting samples of a value of the current flowing through the switch with the current measuring means;

performing a determining step defined by determining a moment of extraction and a conducting state of a circuit formed of the at least one coil and the switch at the moment of extraction for each of the samples;

performing a checking step defined by checking if the moment of extraction for each of the samples satisfies at least one temporal condition with respect to the at least one control signal emitted by the control computer;

performing a comparing step defined by comparing each of the samples with a predetermined threshold value if the at least one temporal condition was satisfied during the checking step; and performing a deducing step defined by deducing a presence and nature of an operating fault of the circuit from results of the comparing step.

2. The process according to claim 1, wherein:

in performing the checking step, the moment of extraction satisfies the at least one temporal condition with respect to the at least one control signal if the moment of extraction is later than a moment of turning on the switch by at least a first time period;

in performing the comparing step, the predetermined threshold value is an open-circuit fault threshold value; and in performing the deducing step, deducing that an operating fault is present and that the nature of the operating fault is an open-circuit fault if a sample is below the open-circuit fault threshold value.

3. The process according to claim 2, which comprises performing the determining and checking steps for all of the samples satisfying the at least one temporal condition of the checking step and whose moment of extraction is earlier than a moment of turning off the switch.

4. The process according to claim 3, which comprises:

providing the ignition device with at least one further circuit having a further coil and a further switch and the current measuring means measuring the current of the switch and a current of the further switch; and determining if the moment of extraction is earlier than a moment of turning on the further switch of the at least one further circuit.

5. The process according to claim 2, which comprises determining the first time period as a function of a predetermined current value, the open-circuit fault threshold value and a sampling period.

6. The process according to claim 1, which comprises:

in performing the checking step, the moment of extraction satisfies the at least one temporal condition with respect to the at least one control signal if the moment of extraction lies within one sampling period from a moment of time defined by a second time period after turning on the switch;

in performing the comparing step, the predetermined threshold value is a short-circuit fault threshold value; and in performing the deducing step, deducing that an operating fault has occurred and that the nature of the operating fault is a short-circuit fault if a sample is above the short-circuit fault threshold value.

7. The process according to claim 6, which comprises:

providing the ignition device with at least two coils connected to respective switches and the current measuring means is a common measuring means for measuring the current of the respective switches; and determining if the moment of extraction lies within an interval of time equal to a sampling period from the moment of turning on the respective switches and the second time lag.

8. The process according to claim 6, which comprises:

providing the ignition device with at least two circuits including a first circuit having the at least one coil and the switch and a second circuit having a further coil and a further switch, and the current measuring means is a common measuring means for measuring the current of the switch and a current of the further switch; and determining if the moment of extraction lies within an interval of time equal to a sampling period from a moment of turning off the further switch of the second circuit and at least a third time lag.

9. In an ignition device having a plurality of circuits each formed of a coil and a switch, a diagnosis apparatus comprising:

current measuring means for measuring a current common to a plurality of circuits;

means for determining a moment of events including a moment of extraction of current measuring samples, and a moment of turning on and off a respective switch of the plurality of circuits;

storage means for recording at least one collection of values including a current sample, a moment of extraction of the current sample, a reference to a conduction state of each of the plurality of circuits, a set of pre-established threshold values and time lag values, and an instruction set forming part of a piece of software; and calculation and comparison means for executing checking and comparison operations defined according to a process by running and executing said instruction set stored in said storage means.

10. In an ignition device having a plurality of circuits each formed of a coil and a switch, an electronic ignition computer comprising:

current measuring means for measuring a current common to a plurality of circuits;

means for determining a moment of events including a moment of extraction of current measuring samples, and a moment of turning on and off a respective switch of the plurality of circuits;

storage means for recording at least one collection of values including a current sample, a moment of extraction of the current sample, a reference to a conduction state of each of the plurality of circuits, a set of pre-established threshold values and time lag values, and an instruction set forming part of a piece of software; and calculation and comparison means for executing checking and comparison operations defined according to a process by running and executing said instruction set stored in said storage means.

* * * * *